US006203471B1

(12) United States Patent
Akihiro

(10) Patent No.: US 6,203,471 B1
(45) Date of Patent: Mar. 20, 2001

(54) ORAL LIP AND CHIN MUSCLE REHABILITATING DEVICE

(75) Inventor: Yoshiaki Akihiro, Kokubunji (JP)

(73) Assignee: Actwell Technology Inc., Taipei (TW)

( * ) Notice: Subject to any disclaimer, the term of this patent is extended or adjusted under 35 U.S.C. 154(b) by 0 days.

(21) Appl. No.: 09/396,373

(22) Filed: Sep. 16, 1999

(30) Foreign Application Priority Data

Sep. 19, 1998 (TW) ..... 87215548

(51) Int. Cl.[7] ..... A63B 23/03
(52) U.S. Cl. ..... 482/11; 602/902; 128/859
(58) Field of Search ..... 602/902; 128/859, 128/848, 861; 482/11

(56) References Cited

U.S. PATENT DOCUMENTS 4,671,260 * 6/1987 Buckner .
4,997,182 * 3/1991 Kussick .

* cited by examiner

*Primary Examiner*—Michael A. Brown
*Assistant Examiner*—Lalita M. Hamilton
(74) *Attorney, Agent, or Firm*—Dougherty & Troxell

(57) ABSTRACT

As oral lip and chin muscle rehabilitating device made of flexible material and having an annular open shape in accordance with the configuration of human oral lips. One side of the upper edge of the opening is formed with a recessed upper lip rest section extending outward and upward. One side of the lower edge of the opening is formed with a recessed lower lip rest section extending outward and downward. The upper and lower lip rest sections respectively receive therein the upper and lower lips of a user. A resilient connecting section is connected between the upper and lower lip rest sections to provide a certain resilient stretching force therefor. The oral lip and chin muscle rehabilitating device is positioned between the upper and lower lips of the user to rehabilitate and train the lip and chin muscle and recover the closing function of the lips. The oral lip and chin muscle rehabilitating device is able to improve and recover the oral functions of the patients suffering disturbance in chewing, swallowing and speaking.

7 Claims, 13 Drawing Sheets

ORAL LIP AND CHIN MUSCLE REHABILITATING DEVICE

BACKGROUND OF THE INVENTION

The present invention relates to an oral lip and chin muscle rehabilitating device, and more particularly to a rehabilitating device which is able to stretch and train the muscle around the mouth of a user. The oral lip and chin muscle rehabilitating device is applicable to those patients suffering disturbance in chewing, swallowing and speaking caused by injury or stroke. The oral lip and chin muscle rehabilitating device is able to recover the normal functions of the muscle of oral cavity, lips and chins.

A cerebral disease patient often suffers monoplegia. Such patient will unconsciously drivel, drop food during chewing, swallow hard and speak unclearly. Therefore, such patient must be treated by rehabilitation of the muscle around the oral cavity. However, there has been no suitable auxiliary rehabilitation implement long since so that the muscle around the oral cavity can be hardly effectively rehabilitated.

SUMMARY OF THE INVENTION

It is therefore a primary object of the present invention to provide oral lip and chin muscle rehabilitating device for rehabilitating the muscle around the oral cavity. The device includes an upper lip rest section, a lower lip rest section and a resilient connecting section connected therebetween. The resilient force of the connecting section is able to properly increase the load on the muscle of the lips and chins so as to easily effectively rehabilitate the muscle around the oral cavity.

The present invention can be best understood through the following description and accompanying drawings wherein:

DETAILED DESCRIPTION OF THE PREFERRED EMBODIMENTS

Figure 1:
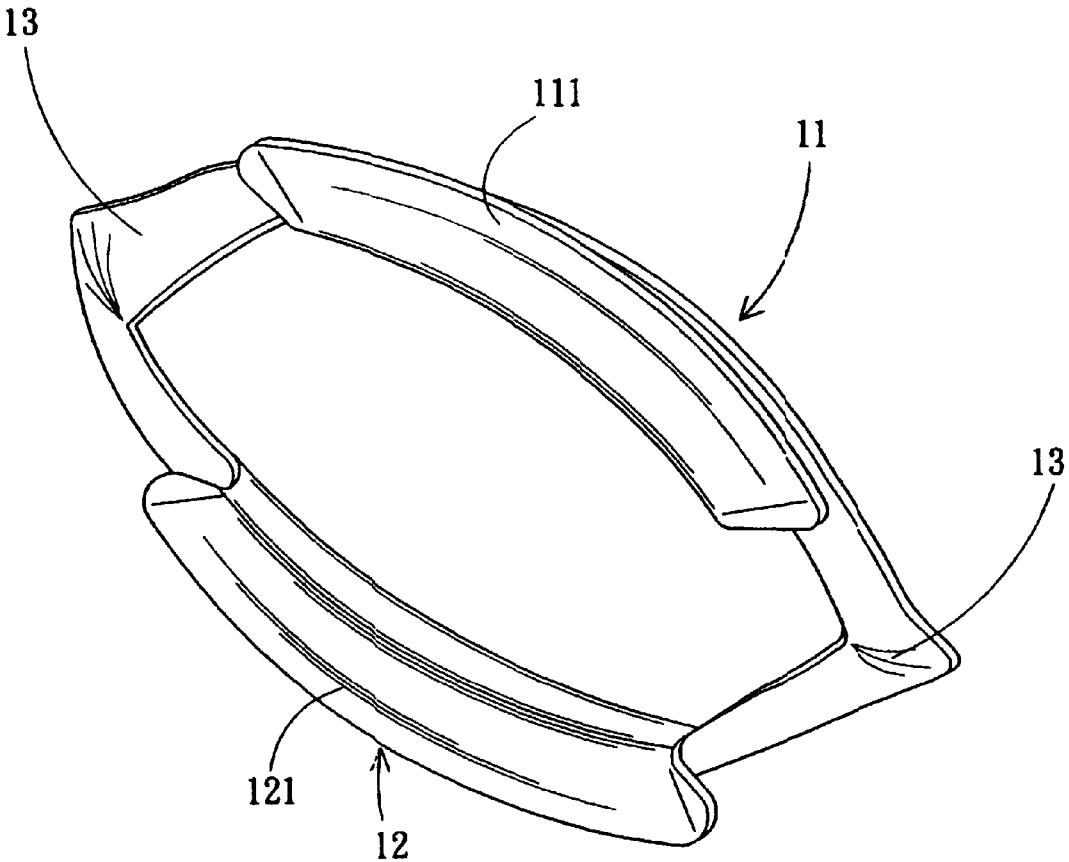
FIG. 1 is a perspective view of a first embodiment of the present invention.
Figure 2:
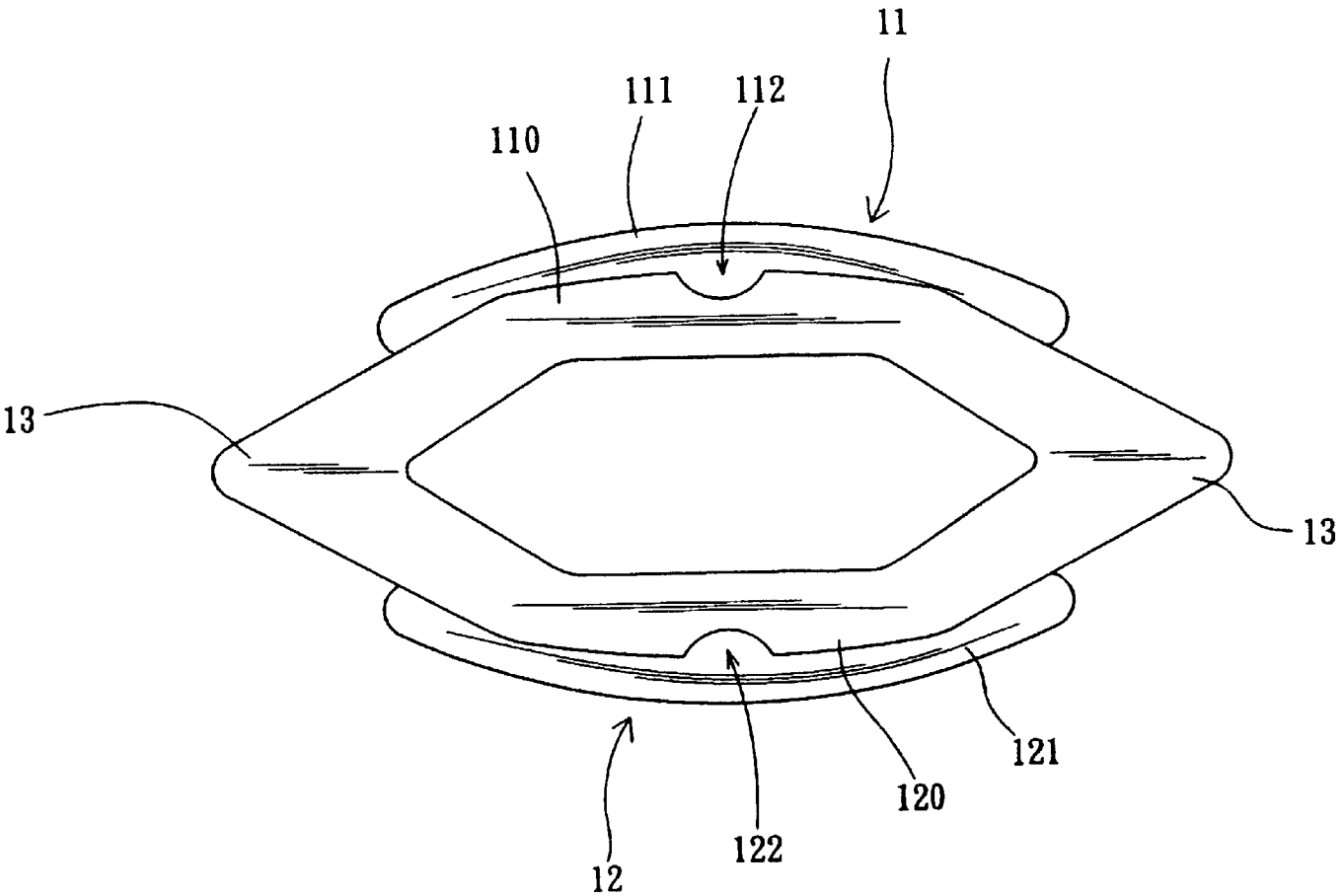
FIG. 2 is a rear plane view according to FIG. 1.
Figure 3:
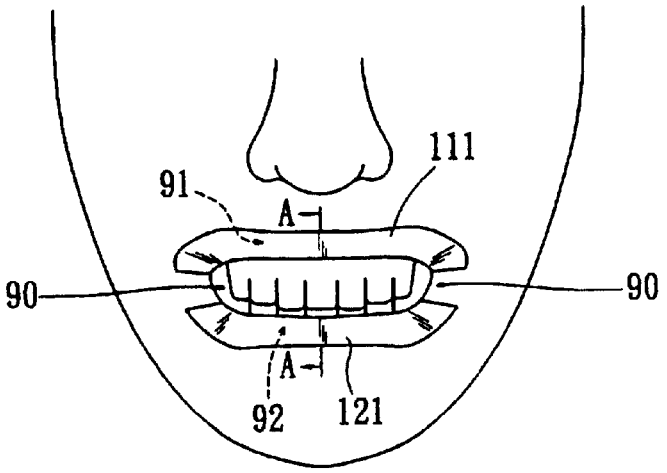
FIG. 3 shows the application of the first embodiment of FIG. 1.
Figure 4:
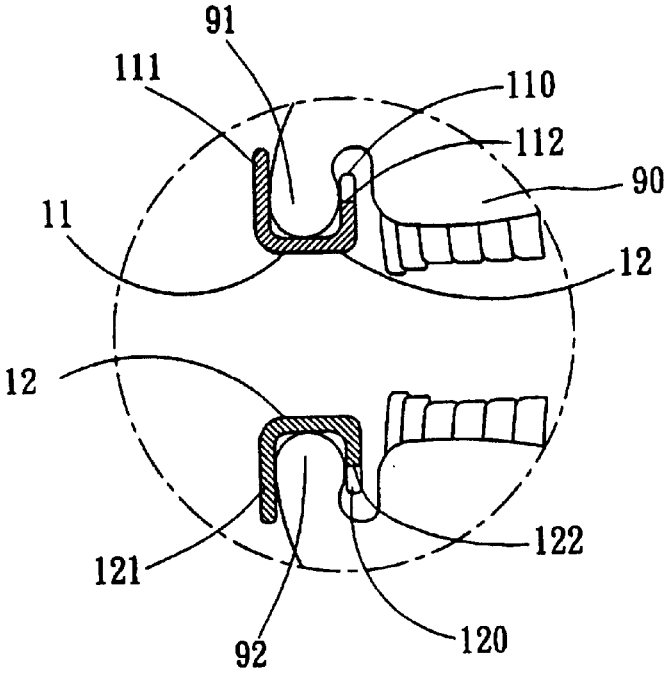
FIG. 4 is a sectional view taken along line A—A of FIG. 3.
Figure 5:
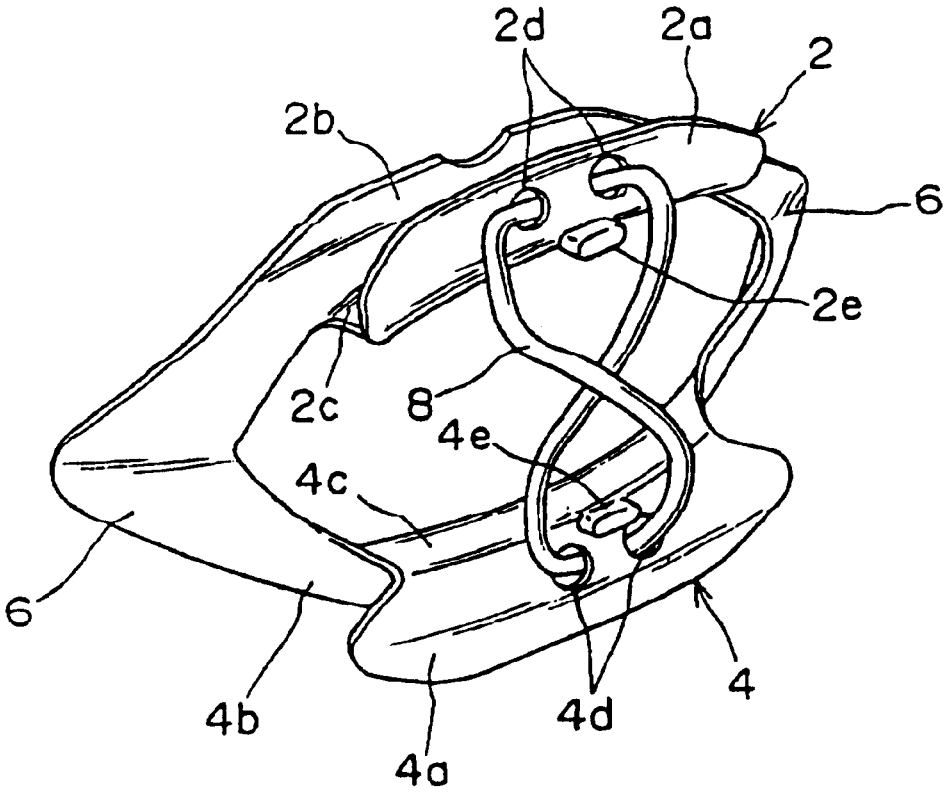
FIG. 5 is a perspective view of a second embodiment of the present invention.
Figure 6:
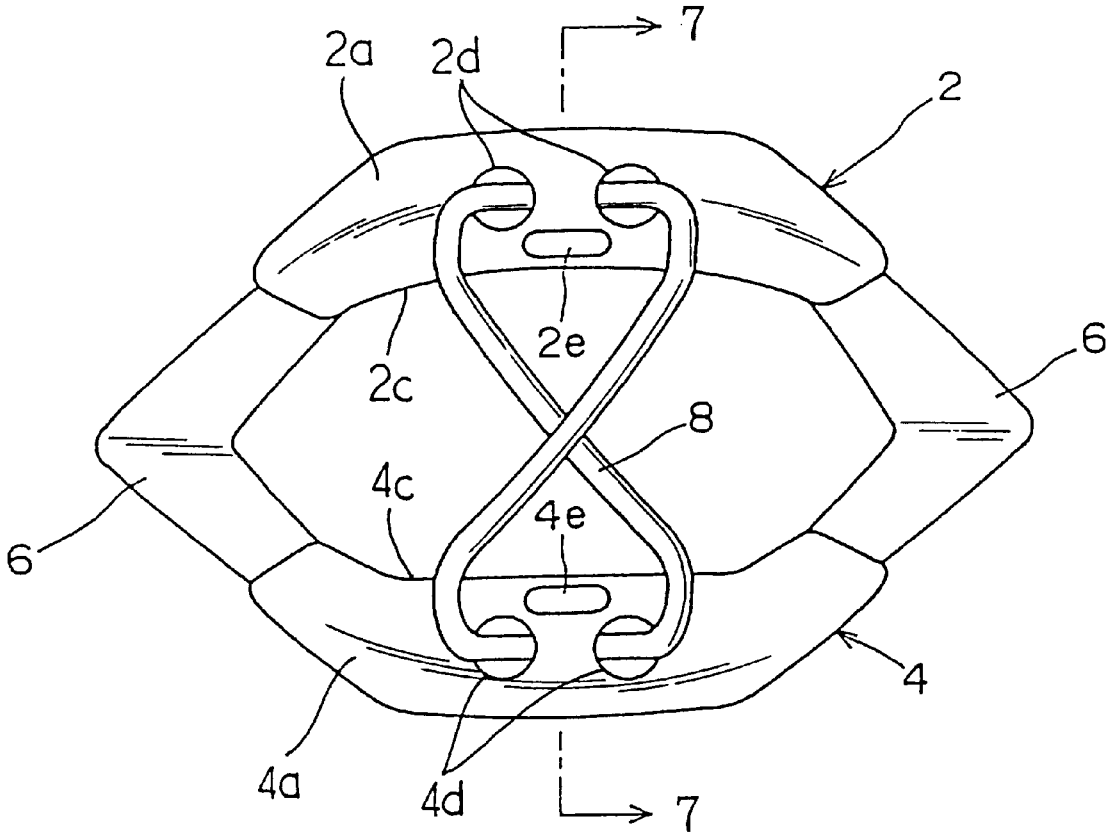
FIG. 6 is a front view according to FIG. 5.

Please refer to FIGS. 1 to 4. The oral lip and chin muscle rehabilitating device of the present invention is a resilient plate body integrally made from resilient synthetic resin (such as silicone, polythylene resin and rubber). The oral lip and chin muscle rehabilitating device has a profile in accordance with the configuration of human oral lips, including an upper lip rest section 11 and a lower lip rest section 12 and a connecting section 13 connected therebetween. The inner sides 110, 120 of the upper and lower lip rest sections 11, 12 are respectively extended outward by a certain distance and then reversely turned to form folds 111, 121 opposite to each other. In addition, the centers of the inner peripheries of the upper and lower lip rest sections 11, 12 are respectively formed with two symmetrical recesses 112, 122. Two lateral sides of the peripheries of the upper and lower lip rest sections 11, 12 are connected by the connecting section 13.

In use, the centers of the upper and lower lip rest sections 11, 12 are pressed and held with fingers to compress flat the orally shaped plate body to an extent suitable for placing into the mouth. Then the plate body is laterally turned by 90 degrees to place one side thereof into the oral cavity. Thereafter, the plate body is turned back into a horizontal state. After the connecting section 13 at one lateral end of the periphery is placed into one side of the oral cavity, the plate body is further pushed in a direction in which the plate body is placed in so as to place the connecting section 13 at the other lateral end into the other side of the oral cavity and respectively firmly retain the connecting section 13 between the front sides of two chains and the teeth in the oral cavity. At this time, the folds 111, 121 of the upper and lower lip rest sections 11, 12 are retained and contained between the upper and lower lips 91, 92. By means of the stretching force of the structure, the oral lips are stretched open. In this state, a suitable resilient stretching force is provided for the oral lip portion and a user can practice the pressing and mating strength of the oral lips so as to train the muscle of the oral lips and chins. Therefore, a patient can use the special design to rehabilitate and restore the oral cavity function. When the structure is placed in the mouth, the recesses 112, 122 serve as escaping spaces through which the ligaments between the lips and teeth pass so that the user can feel more comfortable.

Figure 7:
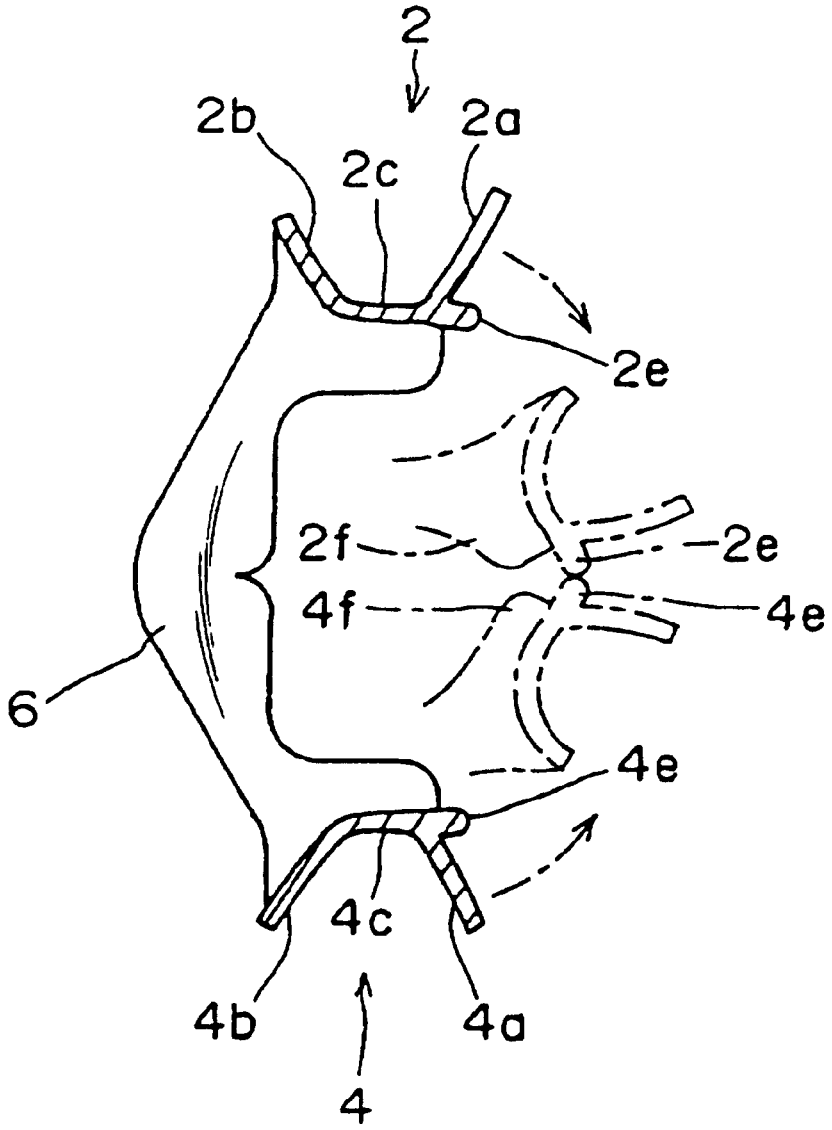
FIG. 7 is a sectional view taken along line A—A of FIG. 6.
Figure 8:
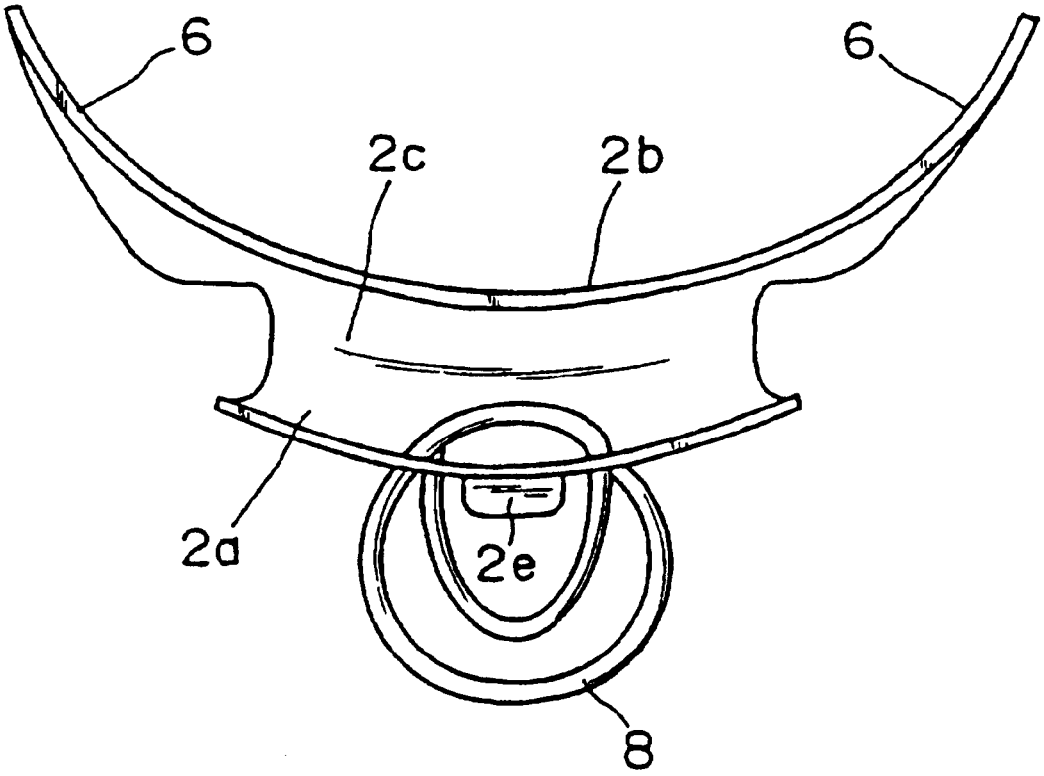
FIG. 8 is a top view according to FIG. 5.

FIGS. 5 to 11 show another embodiment of the present invention. The oral lip and chin muscle rehabilitating device is integrally made from resilient synthetic resin (such as silicone, polythylene resin and rubber). The oral lip and chin muscle rehabilitating device has an upper lip rest section 2 for resting thereon the upper lip and a lower lip rest section 4 for resting thereon the lower lip and a resilient connecting section 6 connected between two ends of the upper and lower lip rest sections. The upper lip rest section 2, lower lip rest section 4 and the connecting section 6 form an annular plate. As shown in FIG. 8, the upper lip rest section 4 and the connecting section 6 are bent and connected with each other according to the curvature of the periphery of the lips. In use, the connecting section 6 is inserted into the oral cavity. In addition, the upper lip rest section 2 includes an exposed section 2*a* which is exposed outside the lips in use, an insertion section 2*b* inserted into the oral cavity and a groove-like connecting section 2*c* connecting the exposed section 2*a* with the insertion section 2*b*. Similarly, the lower lip rest section 4 includes an exposed section 4*a* which is exposed outside the lips in use, an insertion section 4*b* inserted into the oral cavity and a groove-like connecting section 4*c* connecting the exposed section 4*a* with the insertion section 4*b*. The above exposed sections 2*a*, 4*a*, insertion sections 2*b*, 4*b* and connecting sections 2*c*, 4*c* define grooves in which the upper and lower lips are positioned. The exposed sections 2*a*, 4*a* are respectively formed with two perforations 2*d,* 4*d* in which an 8-shaped string is paused. The string is made of durable soft string material such as a resin string. Each of the exposed sections 2*a,* 4*a* is disposed with a projection 2*e,* 4*e.*

Figure 9:
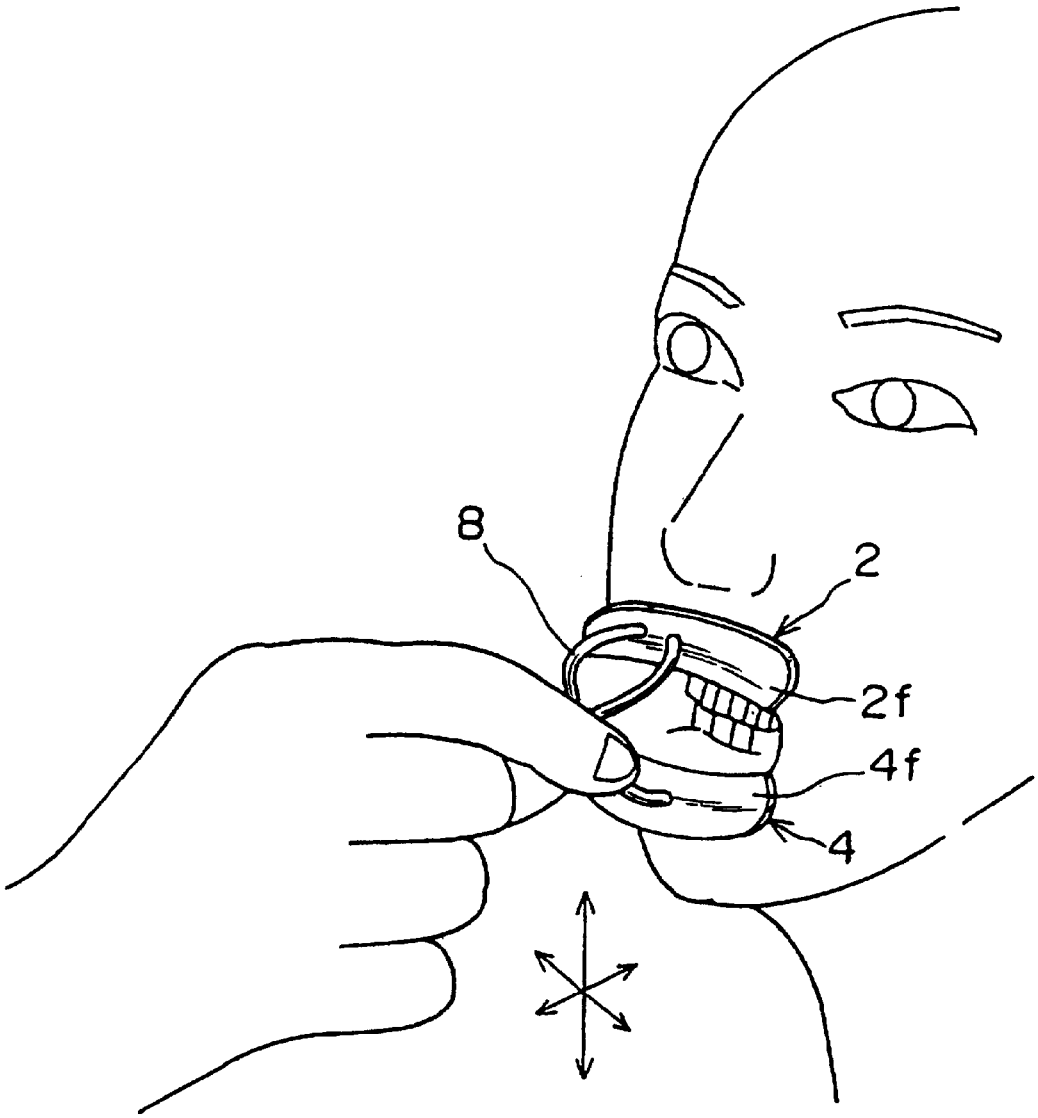
FIG. 9 shows the use of the second embodiment of FIG. 5.

FIG. 9 shows the use of the above oral lip and chin muscle rehabilitating device. The device is positioned at the oral lip position of a user. The upper lip section 2 is inserted into the upper lip, the lower lip rest section 4 is inserted into the cavity. The user holds the 8-shaped string with hand and pull the device back and forth, up and down and left and right so as to stimulate the muscle around the lips. Moreover, after wearing the device, the user can bite and mate the teeth. Under such circumstance, the resilient force of the connecting section can stretch and train the muscle around the lips so as to achieve a rehabilitation effect.

With the oral lip device, the user can also perform up and down exercise of the upper and lower lips. For example, the upper and lower lip rest sections 2, 4 can be closed continuously for 2–4 minutes. This exercise is applicable to those patient suffering OSAS. At this time, the muscle around the lips is pulled to resist against the resilient force of the connecting section. Therefore, the muscle is trained. As shown in FIG. 7, when the upper and lower lip rest sections 2, 4 are closed, the two ends 2*f,* 4*f* thereof may clip the lips of the user. In order to avoid such situation, the projections 2*e,* 4*e* as shown by phantom lines of FIG. 7 can provide a buffering space when the upper and lower lip rest sections 2, 4 are closed.

Several effects can be achieved by training the muscle around the mouth as follows:

1. Rehabilitation effect (recovering the movement function of a patient suffering monoplegia caused by stroke, cerebral embolism, etc.):

It is found that when closing the lips, the lingual apex will be naturally lifted to touch the upper jaw and incisors. By means of this property, the patient suffering paralysis of half side of the tongue caused by stroke can wear the oral lip device for mouth shutting training. The other half of the tongue free from the paralysis will be naturally lifted. At this time, the paralyzed half of the tongue will be driven and lifted. Accordingly, the paralyzed half of the tongue can be rehabilitated without using strength so as to gradually recover the functions of pronouncing, forming food block and swallowing.

2. Disease preventing effect:

According to the recent global medical reports, about 75% of the serious stertorous persons will suffer OSAS. The oxygen content in blood of such patient is 30% less than that of a normal person. This often results in heart disease such as sudden death, arrhythmin of cordis, angina pectoris, myocardial impaction, etc. It is also reported that this often leads to cerebral embolism. The position of the tongue is the main reason for OSAS. In general, the lingual apex is positioned near the upper jaw incisors. The oldening of the tongue muscle will lead to failure of the muscle and make it difficult to place the tongue at the normal position.

3. Cosmetic effect:

A user can wear the above device and exercise. When resiliently closed, the device will pull the oral muscle and increase the load on the oral muscle and also drive the facial muscle (upper lip lifting ligament and lower lip restricting ligament) so as to train the muscle. Therefore, the profile of the face can be more highlighted and solidified. Also, the metabolism of the muscle is expedited to eliminate pimples and crimps.

In addition to the 8-shaped pull string, there are several alternatives as follows:

1. No 8-shaped pull string;
2. The 8-shaped pull string is only passed through one of the upper lip rest section and lower lip rest section;
3. The pull string is respectively passed through the upper lip rest section and lower lip rest section; and
4. Other material is used instead.

Figure 10:
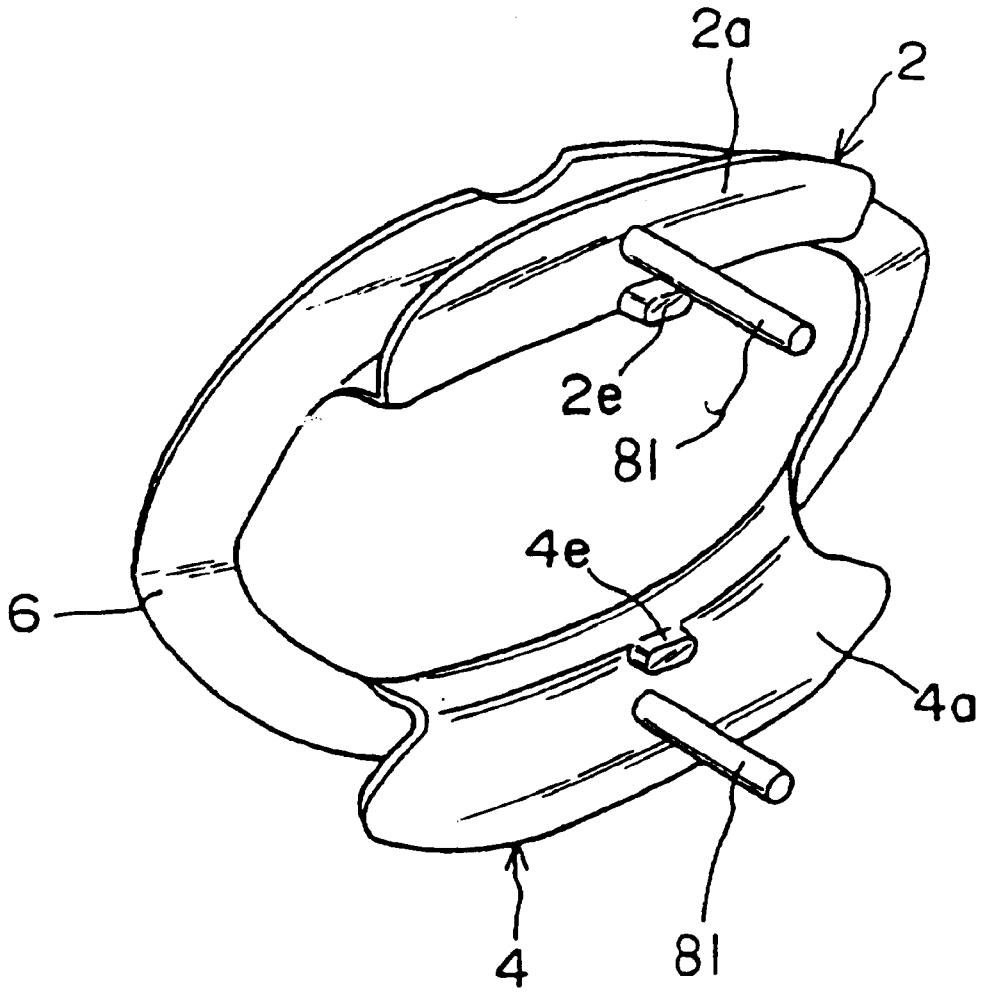
FIG. 10 is a perspective view of a third embodiment of the present invention.

As shown in FIG. 10, the exposed sections 2*a,* 4*a* of the upper and lower lip rest sections are respectively disposed with a stick 81. The user can grasp the stick with fingers to pull up and down and left and right so as to massage the lips.

Figure 11:
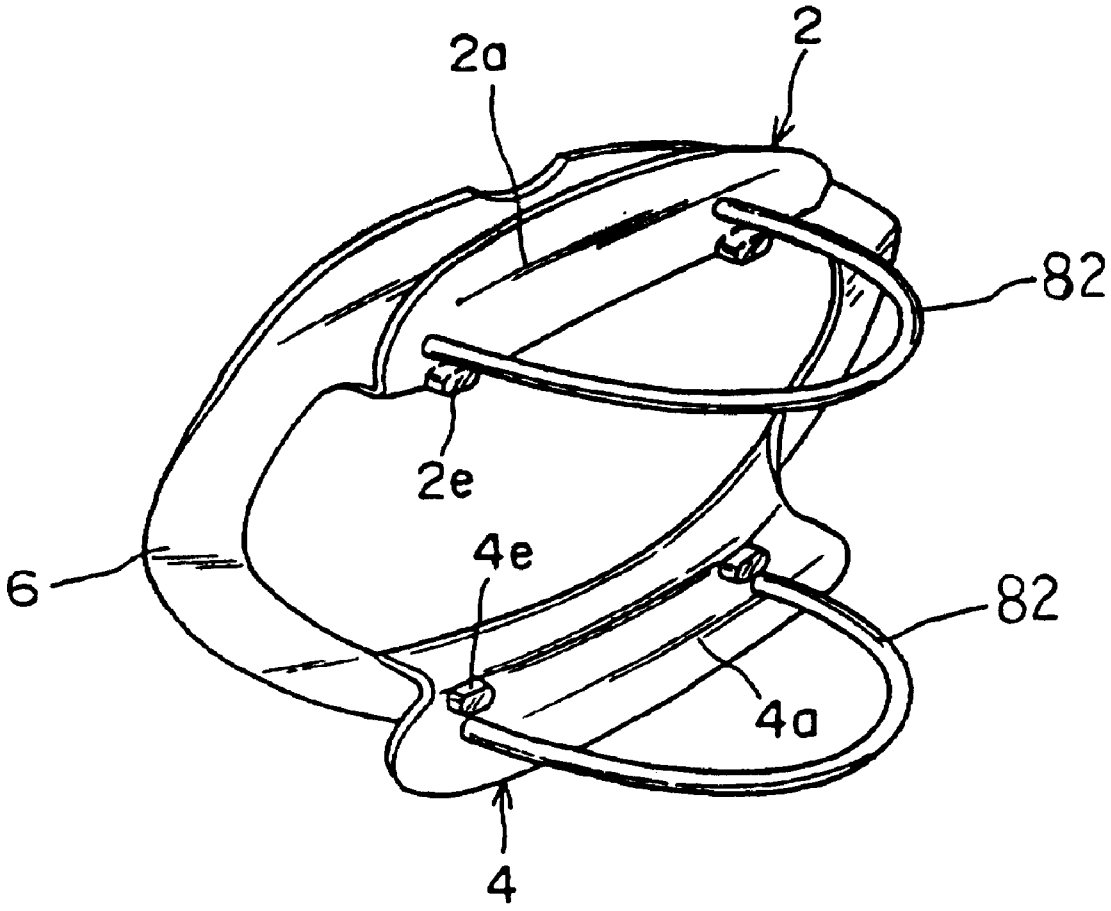
FIG. 11 is a perspective view of fourth embodiment of the present invention.

FIG. 11 shows that the exposed sections 2*a,* 4*a* are respectively disposed with integrally formed annular pull strings 82. Other similar structures capable of pulling the upper and lower lip rest sections can also achieve the same effect.

Figure 12:
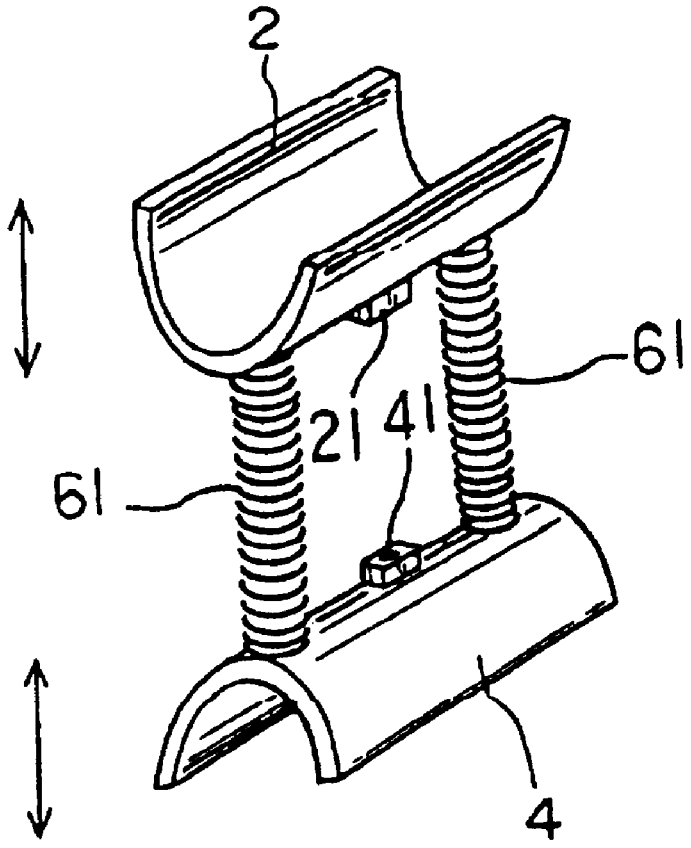
FIG. 12 is a perspective view of a fifth embodiment of the present invention.
Figure 13:
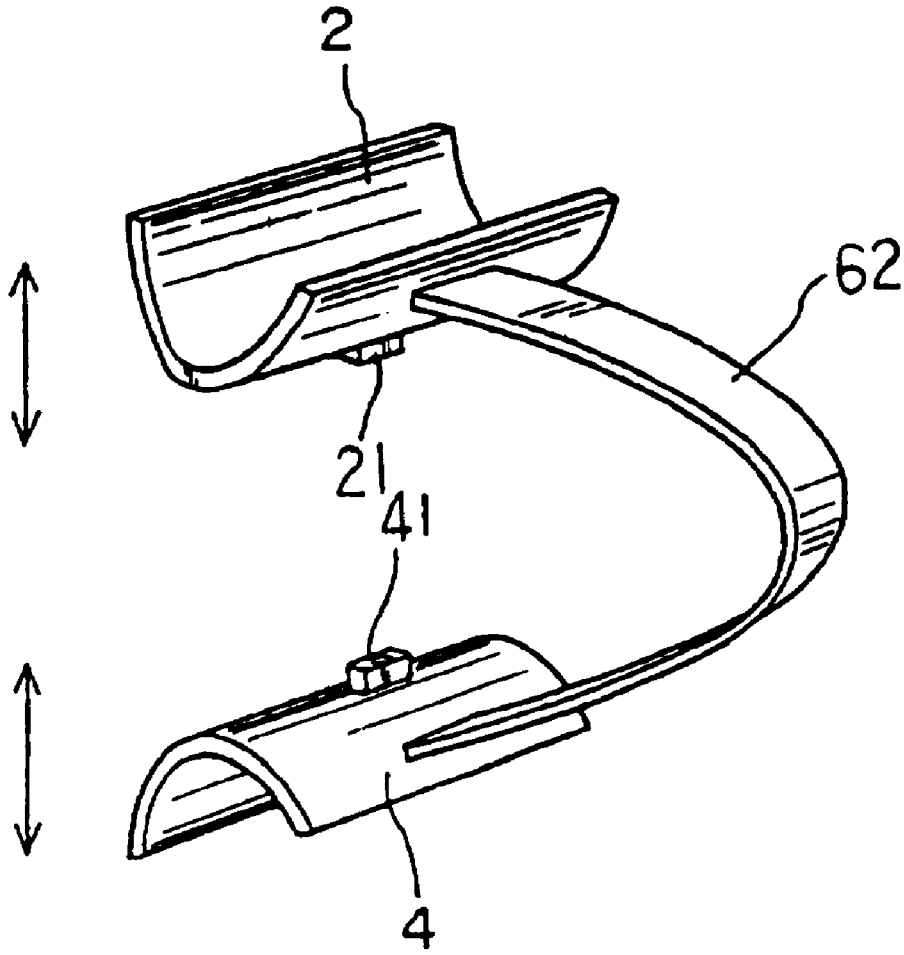
FIG. 13 is a perspective view of a sixth embodiment of the present invention.
Figure 14:
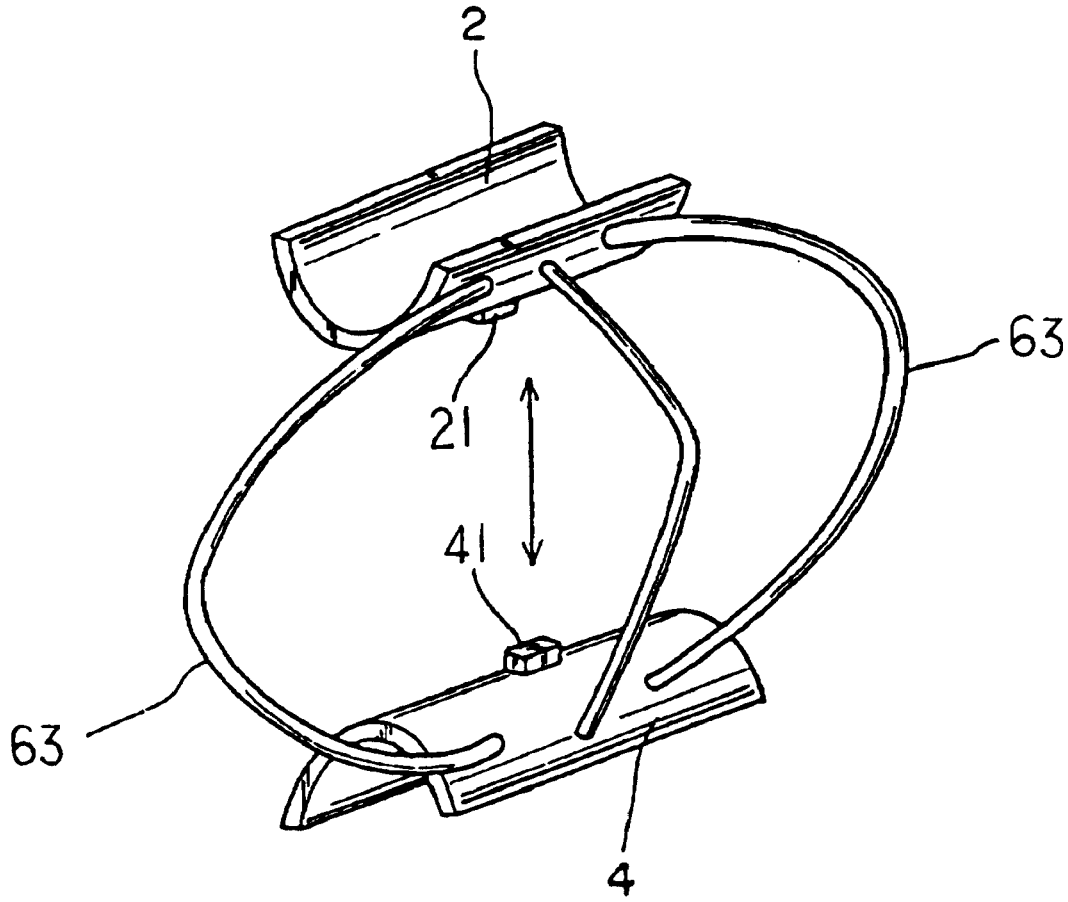
FIG. 14 is a perspective view of a seventh embodiment of the present invention.

In addition, referring to FIGS. 12 to 14, both or one of the upper and lower lip rest sections are respectively disposed with projecting sections 21, 31. When mating the upper and lower lip rest sections, one projecting section touches and stops the other.

FIGS. 12, 13 and 14 shows alternatives of the connecting section. FIG. 12 shows that the connecting section is changed into the type of a rotary spring 61. FIG. 13 shows that the connecting section is a leaf spring 62 or a spring bar 63. The leaf spring 62 is bent forward and two ends thereof are connected with the upper and lower lip rest sections 2, 4. FIG. 14 shows that two spring bars 63 serve as the connecting section. The spring bars are bent and extended to left and right sides of front side. Two ends of the spring bars are respectively connected with the upper and lower lip rest sections 2, 4. In use, the left and right spring bars of the connecting sections 63 are placed outside the oral cavity rather than inside the oral cavity.

The structures shown in FIG. 5 and 12 to 14 can all exert a stretching open force onto the lips when the upper and lower lip rest sections 2, 4 are closed so as to increase the pressure on the lips and train the muscle around the mouth.

In conclusion, the oral lip and chin muscle rehabilitating device of the present invention is able to improve and recover the oral functions of the patients suffering disturbance in chewing, swallowing and speaking.

The above embodiments are only used to illustrate the present invention, not intended to limit the scope thereof. Many modifications of the above embodiments can be made without departing from the spirit of the present invention.

What is claimed is:

1. An oral lip and chin muscle rehabilitating device comprising an upper lip rest section, a lower lip rest section and a resilient connecting section connected therebetween, the oral lip and chin muscle rehabilitating device having a profile in accordance with the configuration of human oral lips wherein a manually operable pulling member is disposed on one or both of the upper and lower lip rest sections; and wherein the pulling member is an 8-shaped string.

2. An oral lip and chin muscle rehabilitating device as claimed in claim 1, wherein the connecting section is connected between two ends of the upper and lower lip rest sections to form an integral annular device.

3. An oral lip and chin muscle rehabilitating device as claimed in claim 1, wherein the pulling member is a stick disposed on one side of each of the upper and lower lip rest sections.

4. An oral lip and chin muscle rehabilitating device as claimed in claim 1, wherein at least a part of the upper and lower lip rest sections is disposed with a projection at the center of the touching portion when closed.

5. An oral lip and chin muscle rehabilitating device as claimed in claim 1, wherein at least a part of the upper and lower lip rest sections is disposed with a projection at the center of the touching portion when closed.

6. An oral lip and chin muscle rehabilitating device as claimed in claim 1, wherein the inner sides of the upper and lower lip rest sections are respectively extended outward by a certain distance and then reversely turned to form folds.

7. An oral lip and chin muscle rehabilitating device as claimed in claim 6, wherein at least one of the centers of the inner sides is formed with a recess.

* * * * *